United States Patent [19]

Papesh

[11] Patent Number: 5,016,465

[45] Date of Patent: May 21, 1991

[54] BENCH MOUNT PULLER SUPPORT

[76] Inventor: Thomas S. Papesh, 1915 N. Broadway, Crest Hill, Ill. 60435

[21] Appl. No.: 375,234

[22] Filed: Jul. 3, 1989

[51] Int. Cl.[5] ..... B21D 1/12

[52] U.S. Cl. ..... 72/457; 72/705

[58] Field of Search ..... 248/558, 637, 670, 676, 248/678, 121, 122, 124, 125, 163.1, 165; 72/705, 457

[56] References Cited

U.S. PATENT DOCUMENTS

| | | | |
|---|---|---|---|
| 4,055,061 | 10/1977 | Bayorgeon | 72/705 |
| 4,404,838 | 9/1983 | Hare | 72/457 |
| 4,510,790 | 4/1985 | Hare | 72/457 |
| 4,720,991 | 1/1988 | Kuhn | 72/457 |
| 4,823,589 | 4/1989 | Maxwell, Jr. | 72/457 |

FOREIGN PATENT DOCUMENTS

| | | | |
|---|---|---|---|
| 249933 | 10/1963 | Australia | 72/705 |
| 2246322 | 5/1975 | France | 72/705 |
| 8707191 | 12/1987 | PCT Int'l Appl. | 72/705 |

*Primary Examiner*—David L. Talbott
*Assistant Examiner*—Robert A. Olson
*Attorney, Agent, or Firm*—Ernest Kettelson

[57] ABSTRACT

A bench mounted puller support to hold and adjust a puller that is utilized to straighten bent auto bodies that are supported and held on an adjustable bench with said support mounted thereto. The bench mounted puller support is comprised of two longitudinal bars with each bar having receiving members on the inner side to receive and connect to the side of the bench, and inserting members on the outer side to insert and connect to a flange assembly that is secured to a tubular support member that supports the puller. The flange assembly has multiple apertures around the perimeter to allow the tubular support member to rotate 360 degrees around the end attached to the flange assembly. The tubular support member has multiple apertures spaced apart longitudinally to allow the puller to adjust to any desired position along the entire length of the tubular support member.

22 Claims, 15 Drawing Sheets

BENCH MOUNT PULLER SUPPORT

BACKGROUND OF THE INVENTION

This invention relates to the field of anchoring and support assemblies to hold a damaged vehicle body in position for straightening and to support a pulling mechanism while applying force to straighten a bent portion of the vehicle body.

Prior art devices of this kind include a bench or other support to hold the vehicle with the pulling mechanism spaced apart from such bench and vehicle and secured to the floor by chains extending from the pulling support mechanism to anchor posts embedded in the floor.

The present invention comprises a support frame for the pulling mechanism which connects to the bench on which the vehicle itself is supported. The support frame for the pulling mechanism has a pair of spaced apart longitudinally extending members with lateral connecting members extending inwardly for connection to the vehicle support bench which supports auto bodies for straightening. A plurality of puller connecting members extend outwardly on the opposite side of each of the longitudinally extending members to receive a puller stand used to support the puller that straightens the auto body.

The invention includes a pivot mounting mechanism to enable rotating the puller support stand to a plurality of radial positions when the puller support stand is received on one of the puller connecting members. This allows the puller to be angularly positioned relative to a variety of damaged areas of an auto body to enable the puller to straighten the bent portion, since the puller support stand can be rotated from the vertical to the horizontal and to extend at any desired angle in between.

SUMMARY OF THE INVENTION

It is an object of this invention to provide a support frame for a pulling mechanism that connects to a bench that supports a damaged auto body wherein the support frame has a pair of spaced apart longitudinally extending members with lateral connecting members extending inwardly for connection to the bench.

It is an object of this invention to provide a support frame for a pulling mechanism that connects to a bench that supports a damaged auto body wherein the support frame's longitudinally extending members have a plurality of puller connecting members extending outwardly and opposite the lateral connecting members, to receive a puller stand used to support the puller that straightens the auto body.

It is an object of this invention to provide a support frame for a pulling mechanism that connects to a bench that supports a damaged auto body wherein a pivot mounting mechanism is received on any one of the puller connecting members to enable rotation of the puller support stand to a plurality of radial positions.

It is an object of this invention to provide a support frame for a pulling mechanism that connects to a bench that supports a damaged auto body wherein the pulling mechanism requires no anchoring equipment to attach the pulling mechanism to the floor.

It is an object of this invention to provide a support frame for a pulling mechanism that connects to a bench that supports a damaged auto body wherein the pulling mechanism can be placed adjacent to any bent area of an auto body to enable the straightening of that bent area.

It is an object of this invention to provide a support frame for a pulling mechanism that connects to a bench that supports a damaged auto body wherein the pivot mounting mechanism of the puller support includes a sleeve member for fast connection and disconnection from the puller connecting member.

It is an object of this invention to provide a support frame for a pulling mechanism that connects to a bench that supports a damaged auto body wherein the pivot mounting mechanism of the puller support includes a spring loaded pin member for fast locking and unlocking of the pivot mounting mechanism in any position.

DESCRIPTION OF PREFERRED EMBODIMENT

Figure 1:
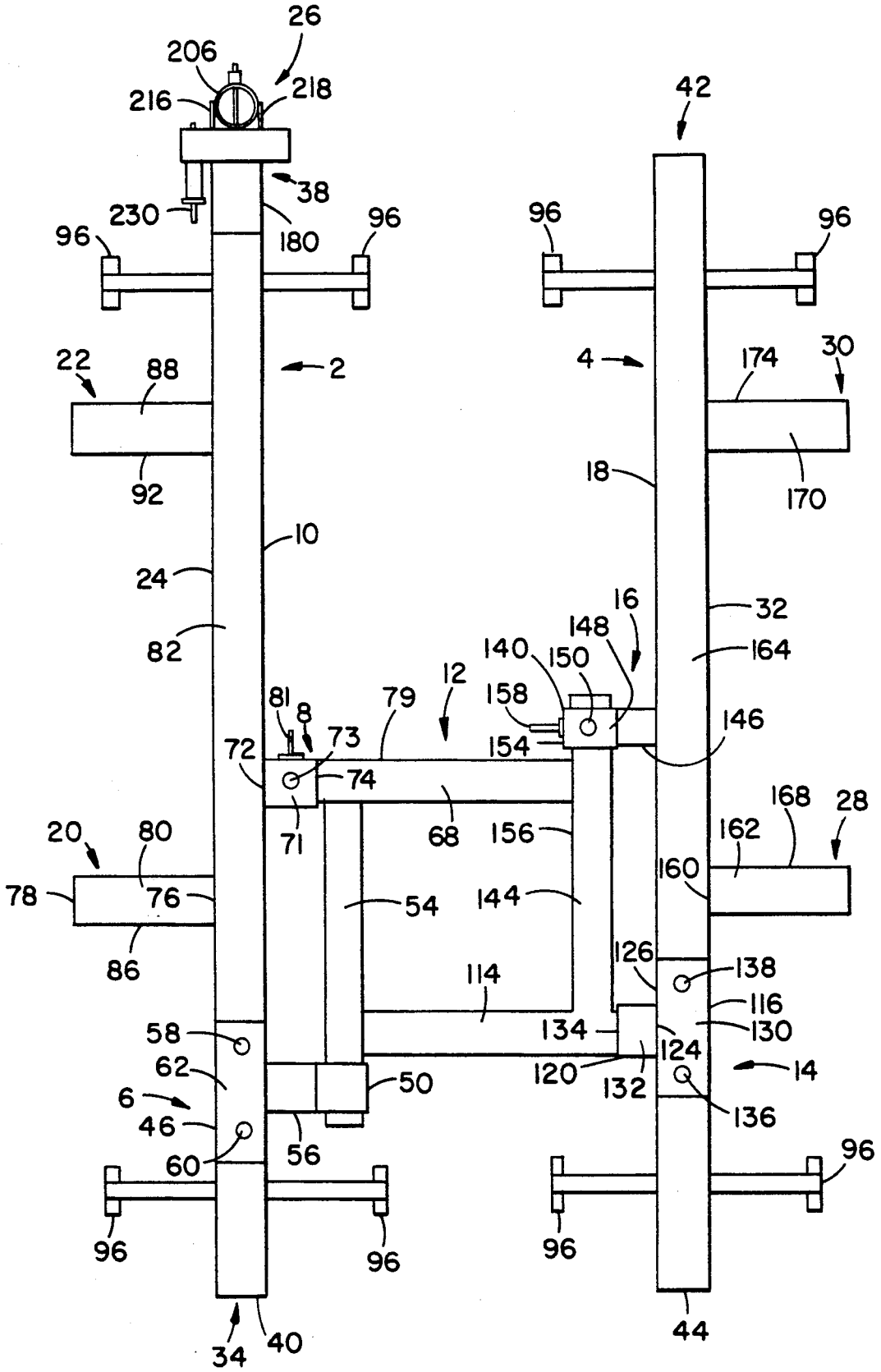
FIG. 1 is a plan view of the dual bench mounted puller support assembly connected to a bench for straightening auto bodies with a puller support assembly in a vertical plane mounted to the first longitudinal bar member in accordance with this invention.
Figure 2:
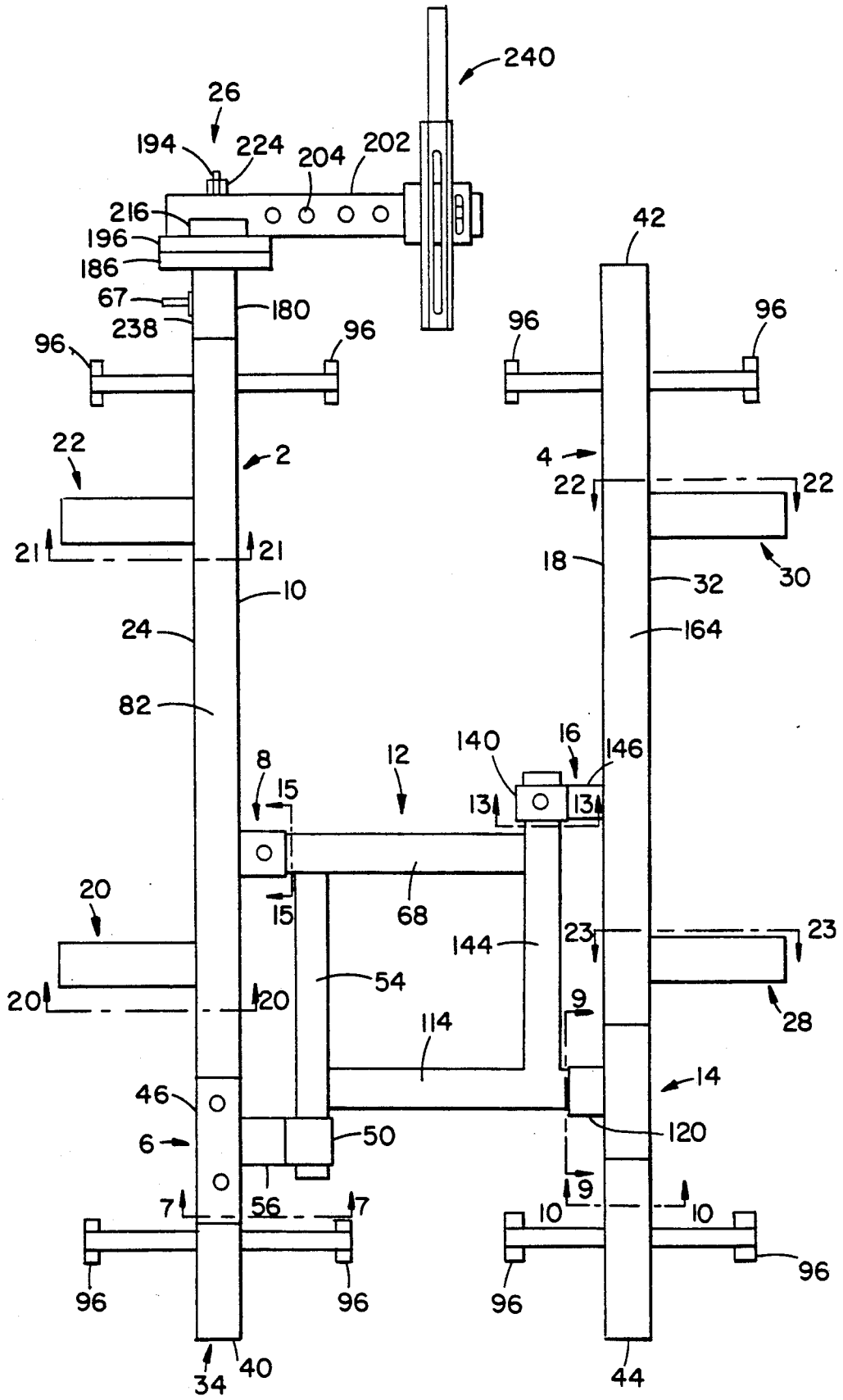
FIG. 2 is a plan view of the dual bench mounted puller support assembly connected to a bench for straightening auto bodies with a puller and puller support assembly in a horizontal plane mounted to the first longitudinal bar member in accordance with this invention.
Figure 3:
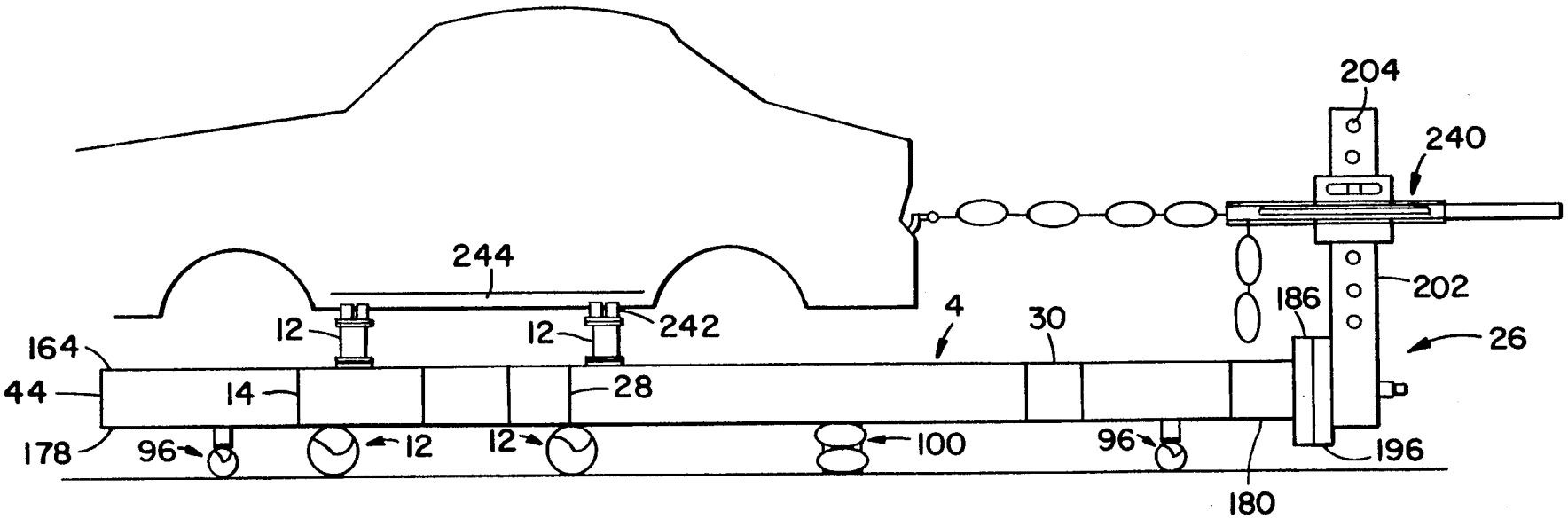
FIG. 3 is a side elevation view of the dual support assembly shown in FIG. 1 with an auto body shown gripped by clamps mounted on the frame with a puller and puller support assembly mounted in a vertical plane to the second longitudinal bar member.
Figure 4:
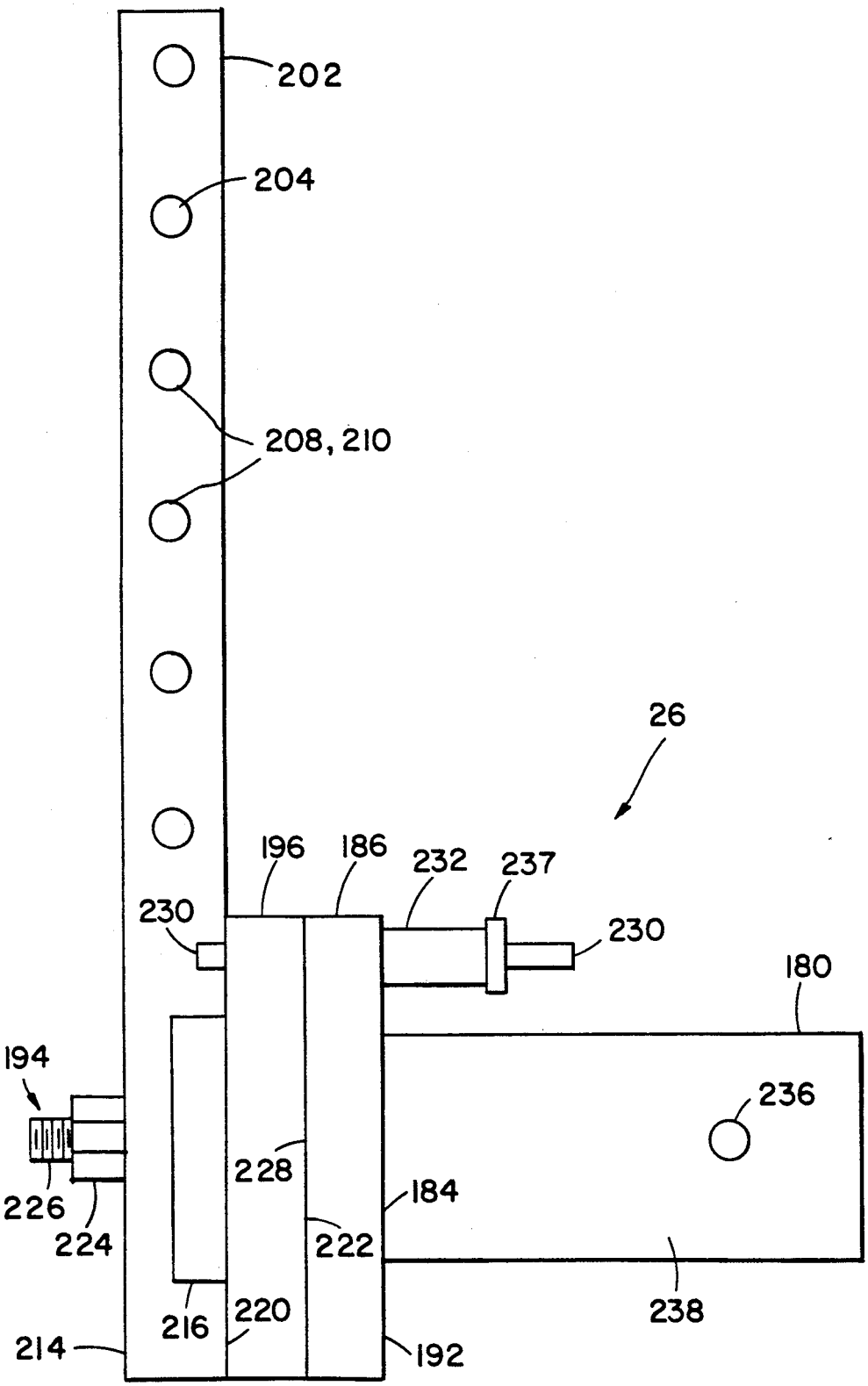
FIG. 4 is a side elevation view of the puller support assembly shown in FIG. 3.
Figure 5:
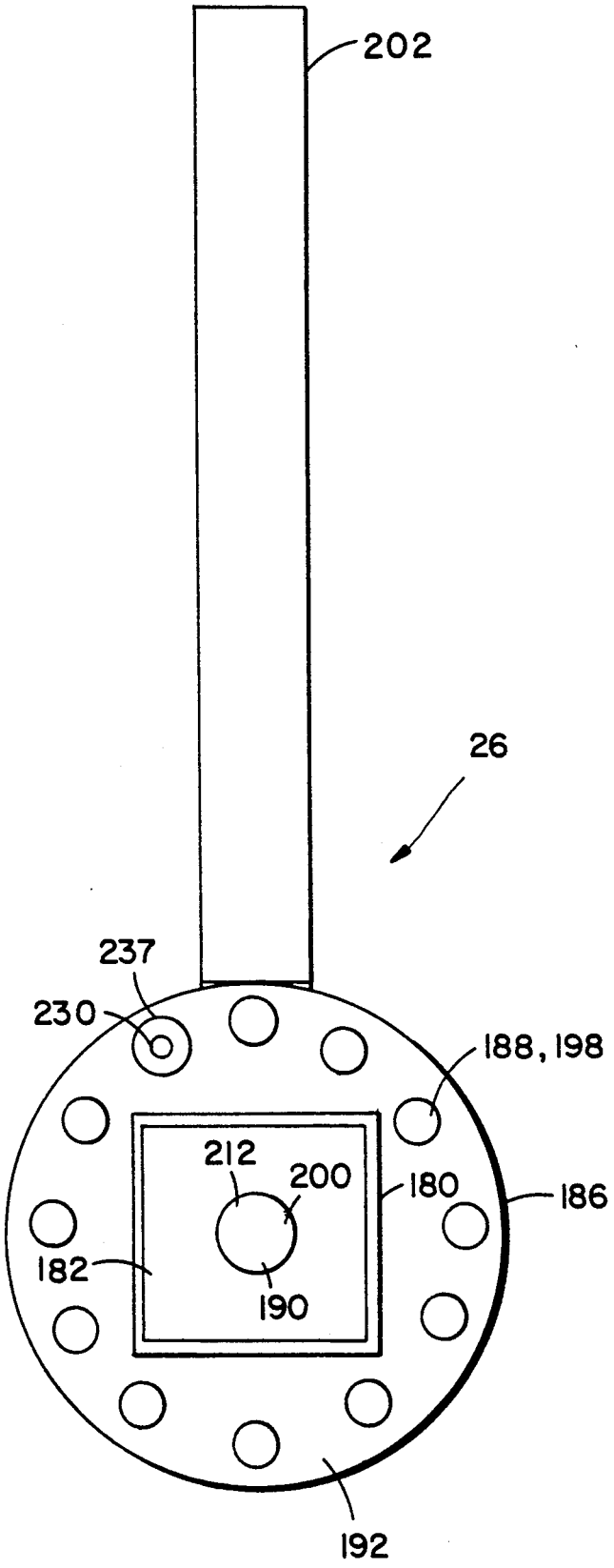
FIG. 5 is an elevation view of the puller support assembly shown in FIG. 4.
Figure 7:
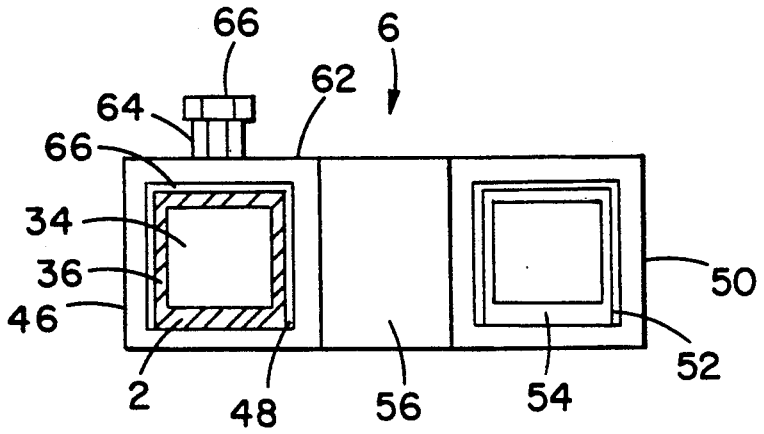
FIG. 7 is a section view taken on line 7—7 of FIG. 2.
Figure 6:
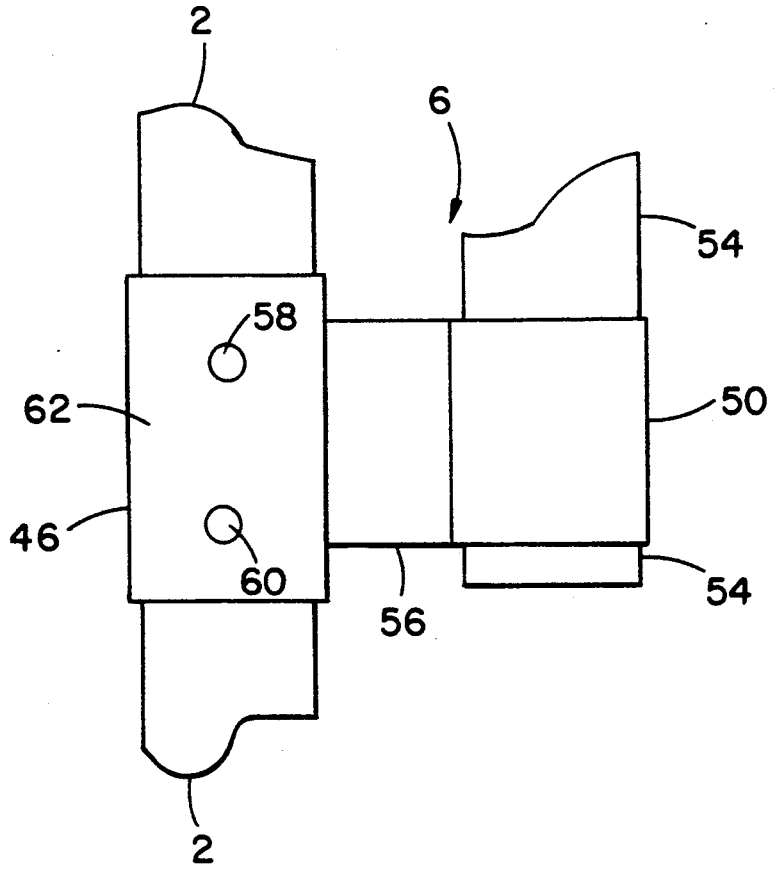
FIG. 6 is a plan view of a first lateral connecting member for connecting the first longitudinal bar member to a first side member of the bench.
Figure 10:
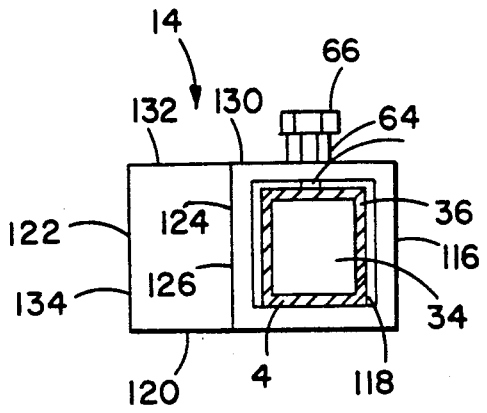
FIG. 10 is a section view taken on line 10—10 of FIG. 2.
Figure 9:
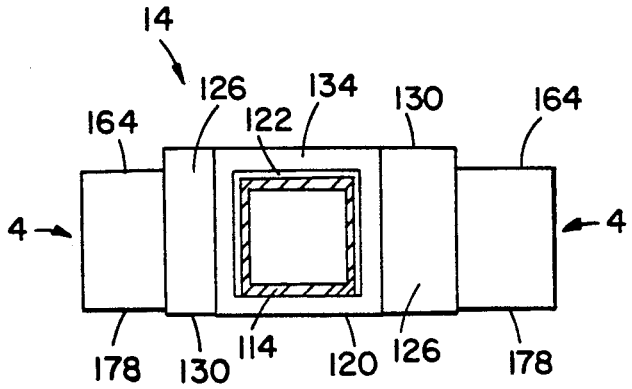
FIG. 9 is a section view taken on line 9—9 of FIG. 2.
Figure 8:
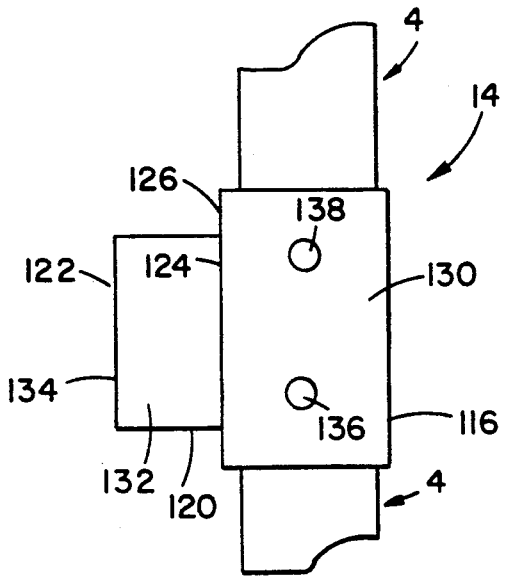
FIG. 8 is a plan view of a first lateral connecting member for connecting the second longitudinal bar member to a second end member of the bench.
Figure 13:
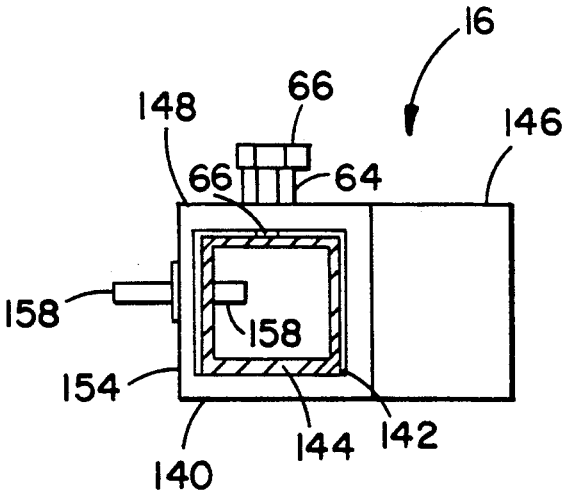
FIG. 13 is a section view taken on line 13—13 of FIG. 2.
Figure 12:
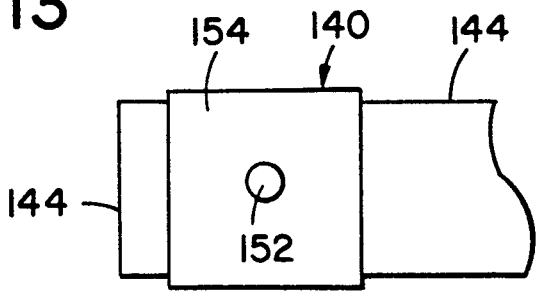
FIG. 12 is a side elevation view of the second lateral connecting member shown in FIG. 11.
Figure 11:
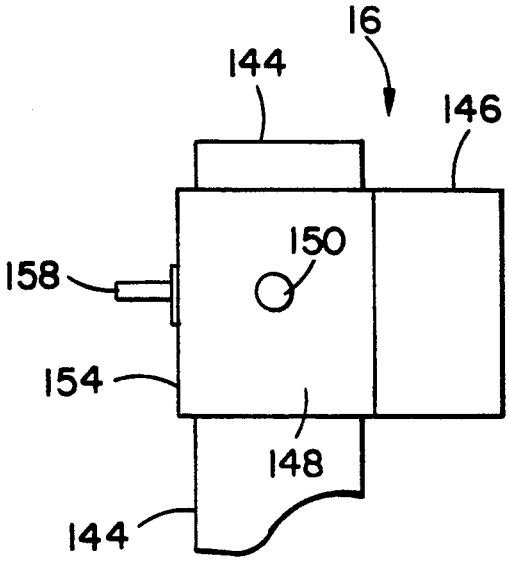
FIG. 11 is a plan view of a second lateral connecting member for connecting the second longitudinal bar member to a second side member of the bench.
Figure 16:
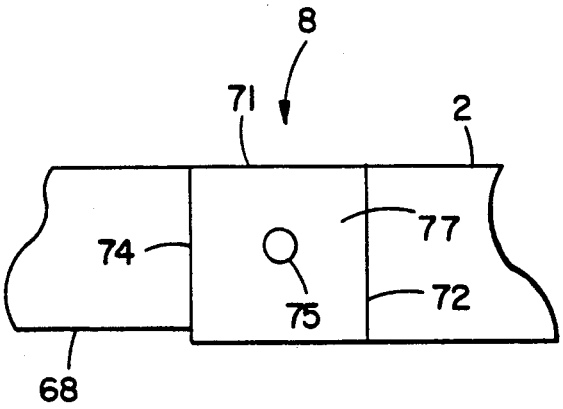
FIG. 16 a side elevation view of the second lateral connecting shown in FIG. 14.
Figure 15:
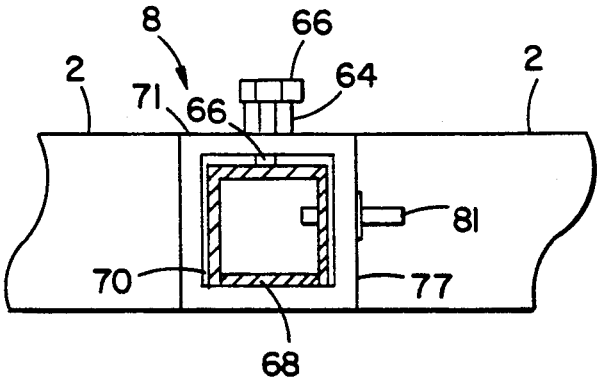
FIG. 15 is a section view taken on line 15—15 of FIG. 2.
Figure 14:
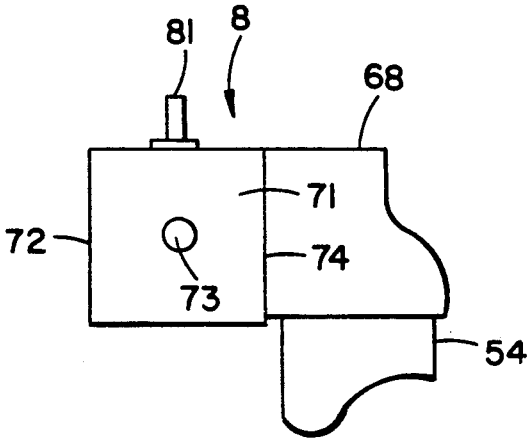
FIG. 14 is a plan view of a second lateral connecting member for connecting the first longitudinal bar member to a first end member of the bench.
Figure 17:
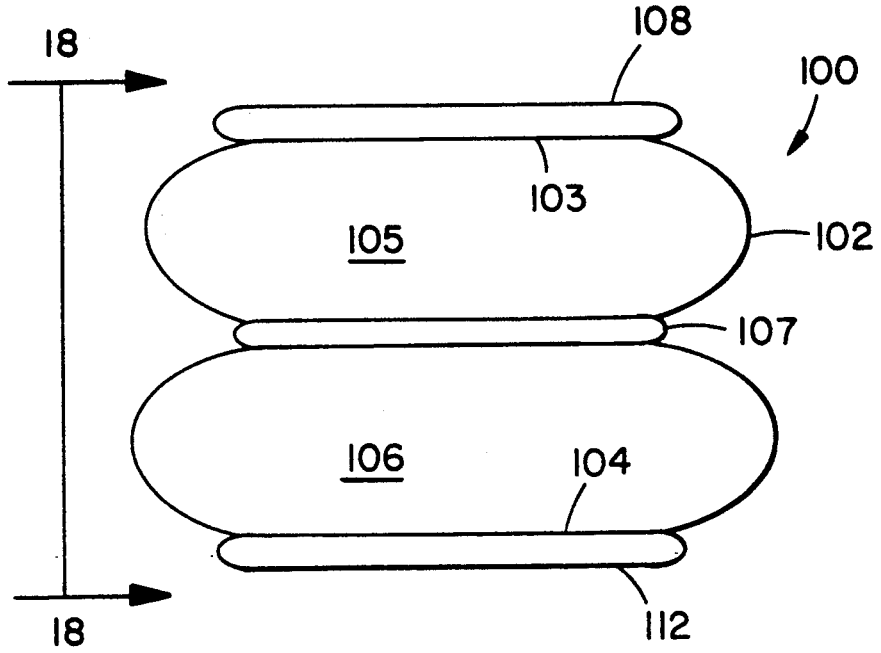
FIG. 17 is a side elevation view of the air spring to elevate the longitudinal bar members.
Figure 18:
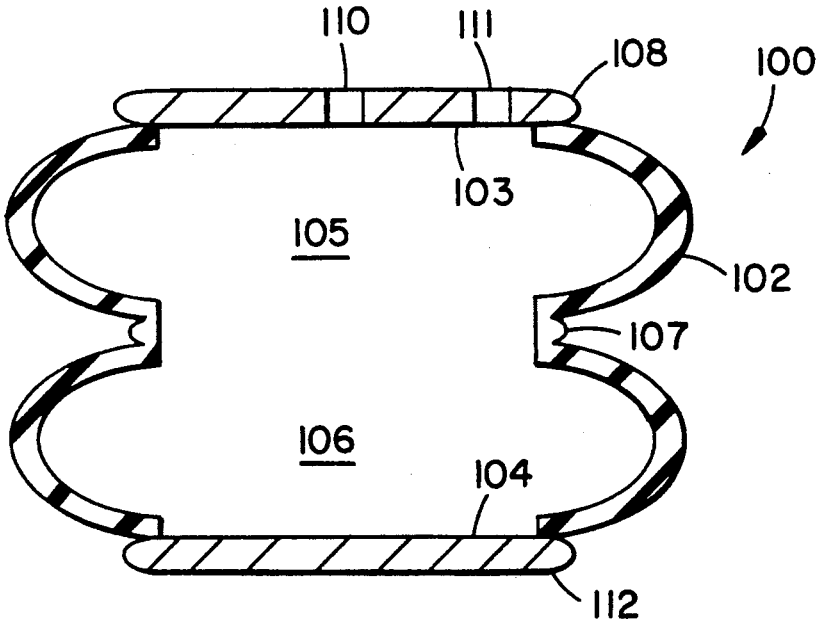
FIG. 18 is a section view taken on line 18—18 of FIG. 17.
Figure 19:
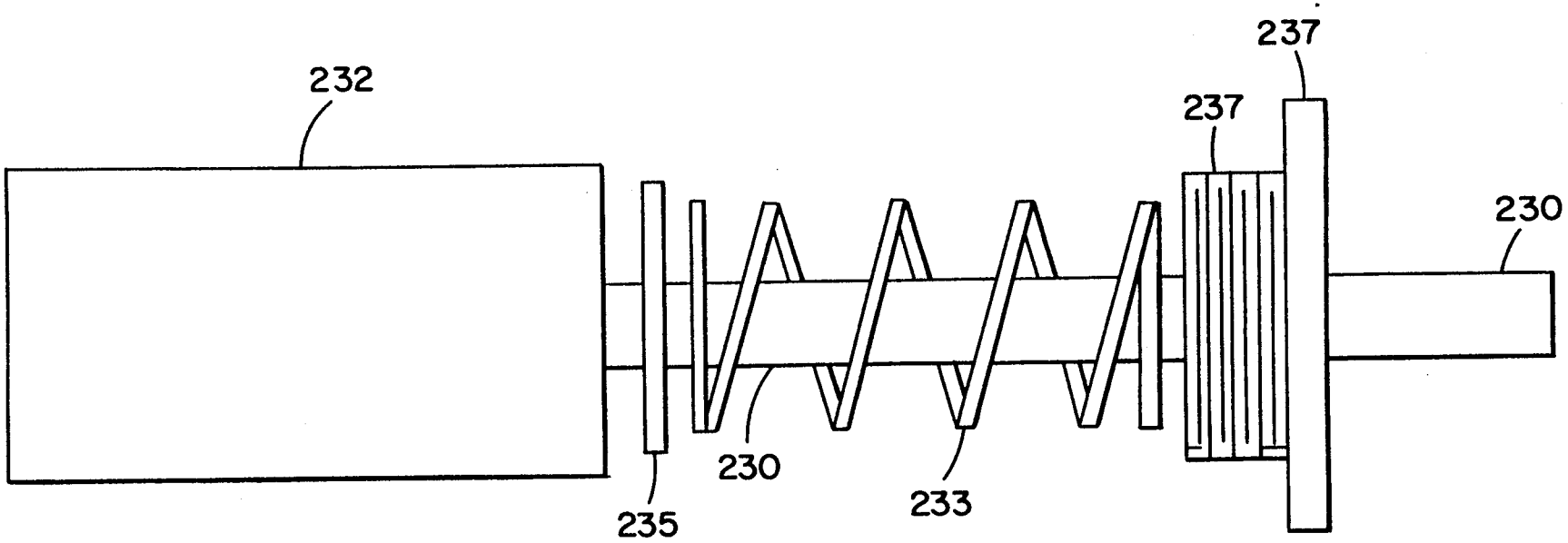
FIG. 19 is an exploded view of the spring loaded retaining pin to secure the puller support assembly.
Figure 20:
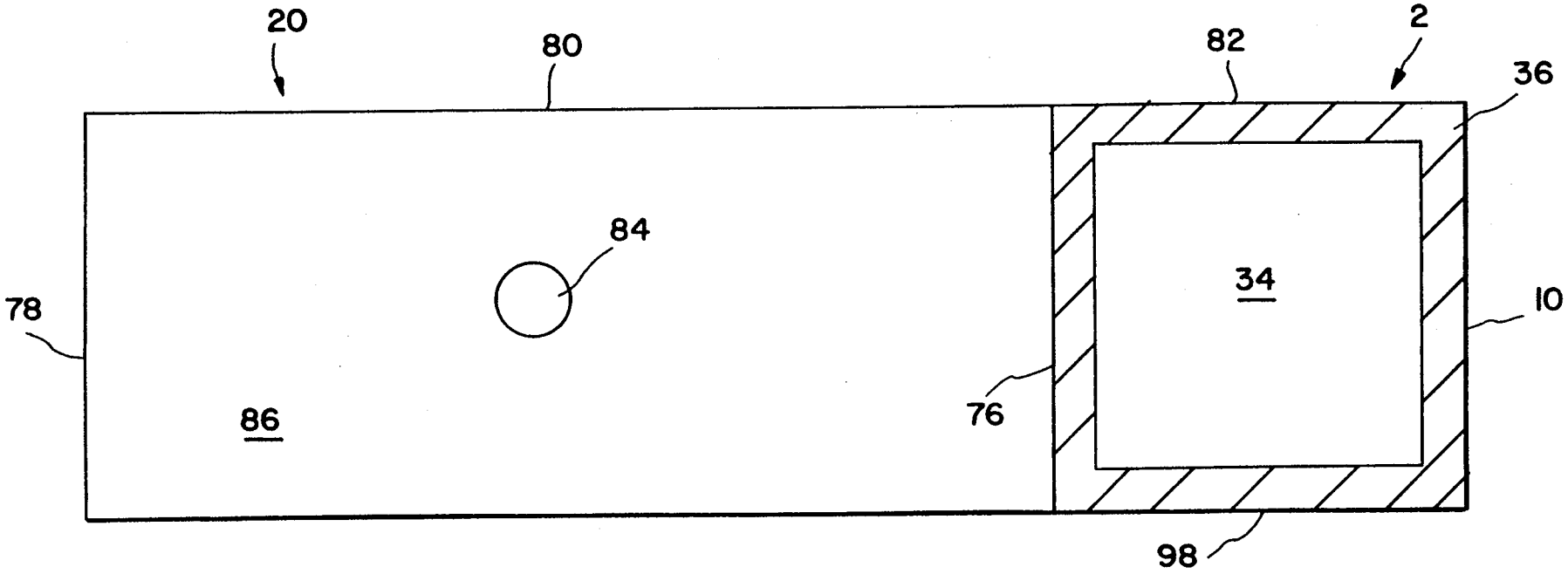
FIG. 20 is a section view taken on line 20—20 of FIG. 2.
Figure 21:
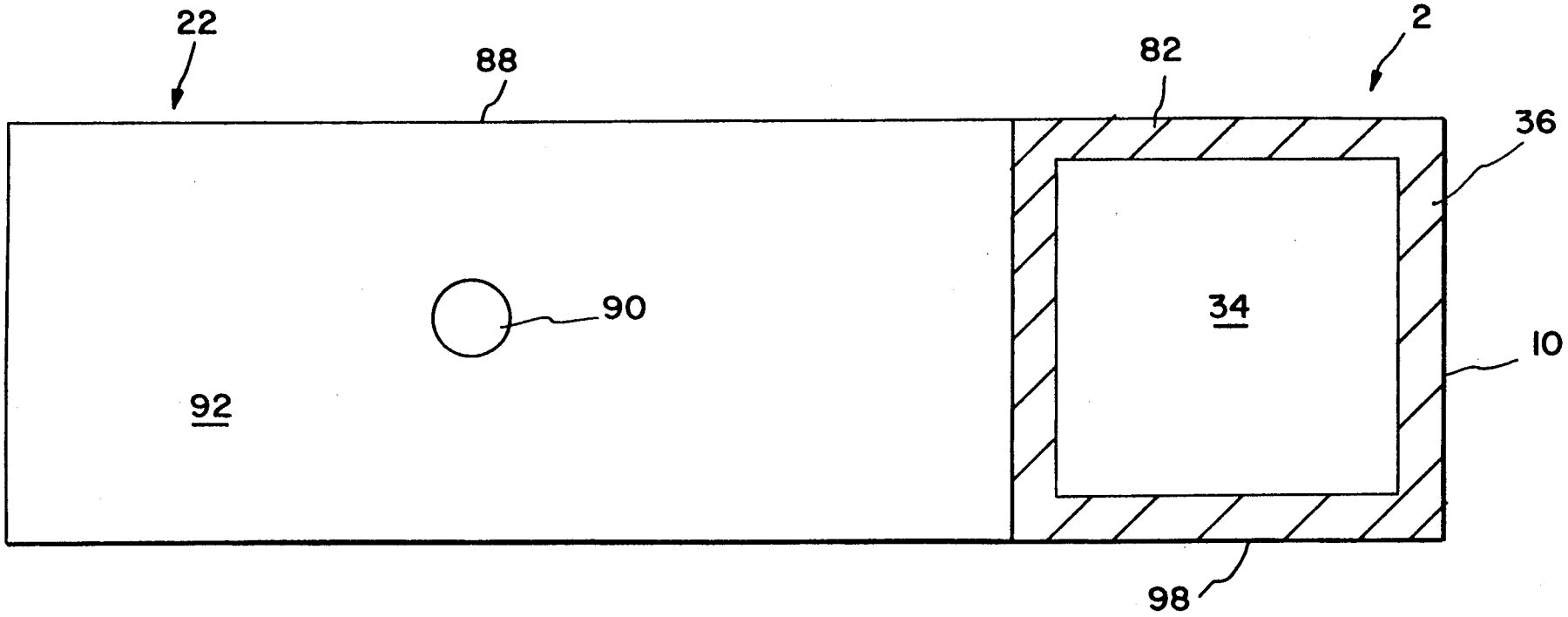
FIG. 21 is a section view taken on line 21—21 of FIG. 2.
Figure 22:
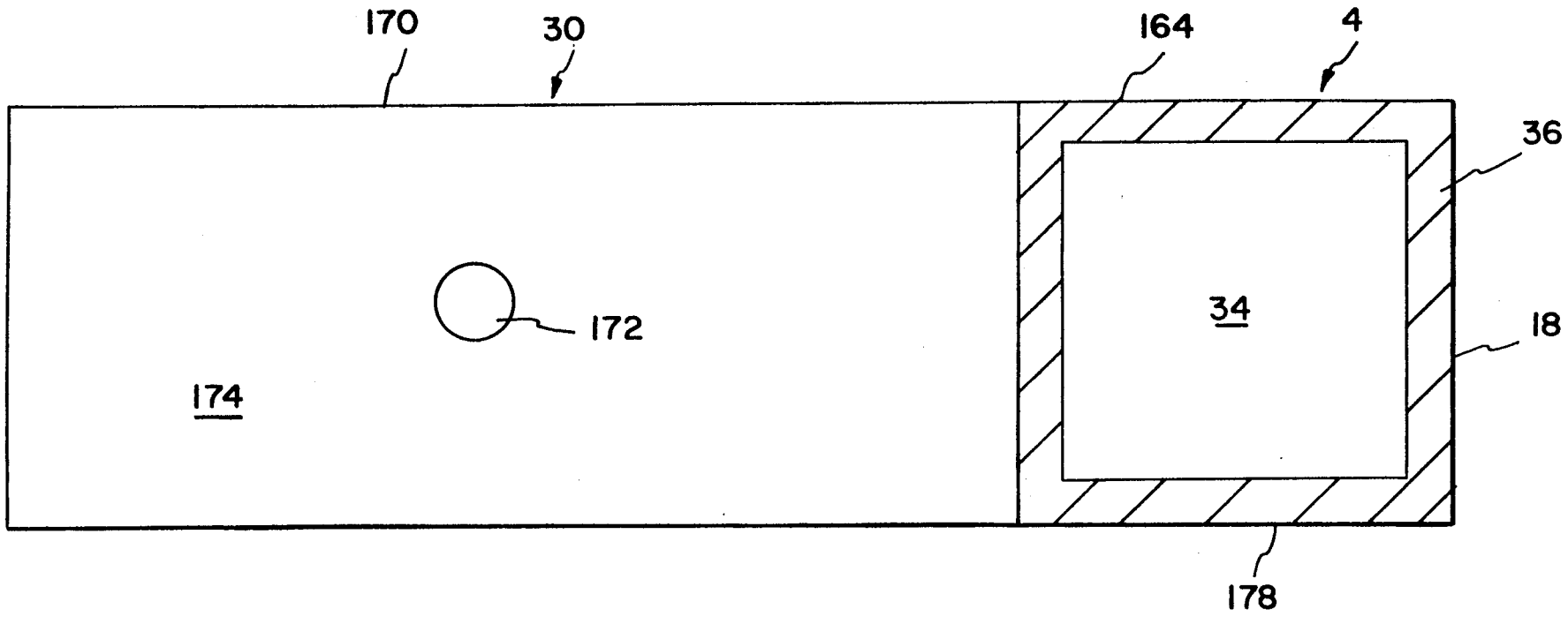
FIG. 22 is a section view taken on line 22—22 of FIG. 2.
Figure 23:
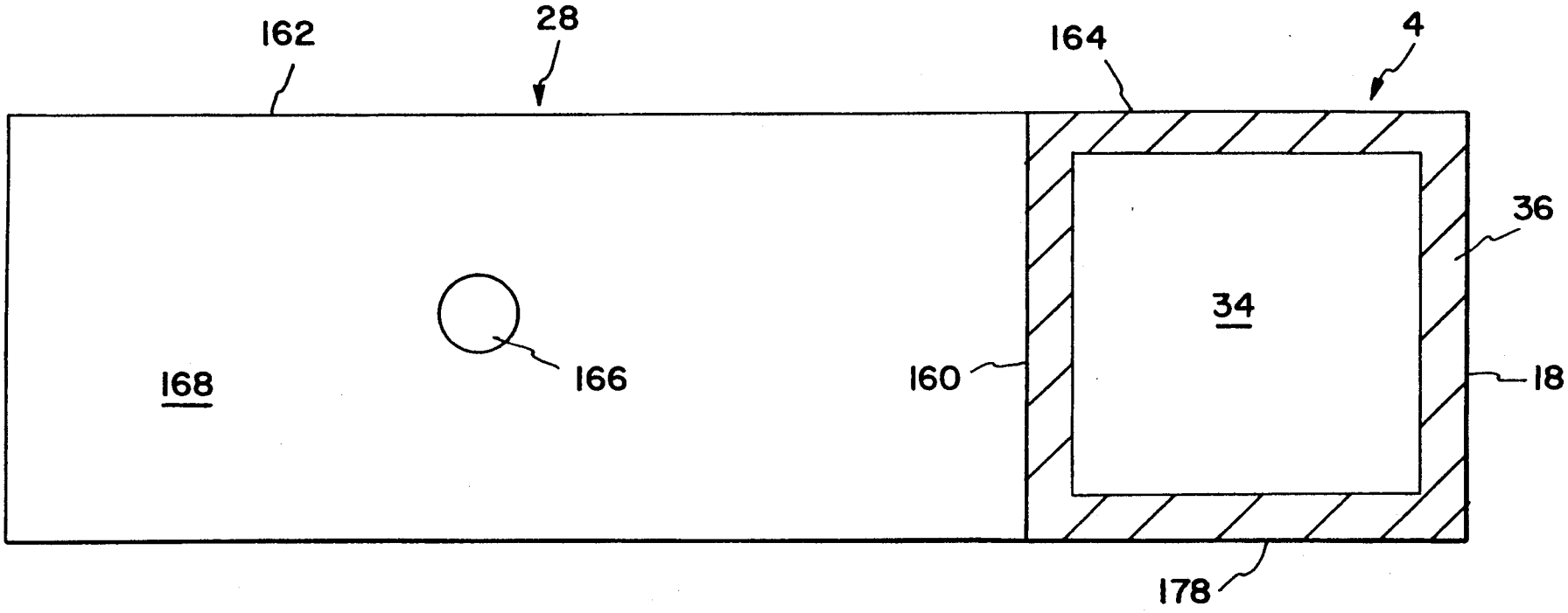
FIG. 23 is a section view taken on line 23—23 of FIG. 2.

A bench mounted puller support frame to hold and adjust a puller that is utilized to straighten bent auto bodies that are supported and held on an adjustable bench with said puller support frame mounted to said bench, includes a first longitudinal bar member 2 and a second longitudinal bar member 4 with the first lateral connecting member 6 and a second lateral connecting member 8 to support and secure the first bar member 2 to a bench 12 that supports and holds an auto body.

The second longitudinal bar member 4 has a first lateral connecting member 14 and a second lateral connecting member 16 to support and secure the second longitudinal bar member 4 to a bench 12 that supports and holds an auto body.

The first longitudinal bar member 2 has a first puller connecting member 20 and a second puller connecting member 22 both attached to the outer side 24 of the first longitudinal bar member 2 to receive a puller support assembly 26. The second longitudinal bar member 4 has a first puller connecting member 28 and a second puller connecting member 30 both attached to the outer side 32 of the second longitudinal bar member 4 to receive a puller assembly 26.

The longitudinal bar members 2 and 4 are tubular having a cavity 34 extending the length thereof. The bar members have a square cross-section, but the bar members could be of other cross-sectional configuration such as circular. The bar members are approximately 10 feet long with each side of the square cross-section measuring 4 inches with a metal wall 36 dimension of approximately ¼".

The first bar member 2 has a front end 38 and rear end 40 with both ends open and exposing the cavity 34 traversing the bar member. The front end 38 and rear end 40 are capable of receiving a puller assembly 26.

The second bar member 4 has a front end 42 and rear end 44 with both ends open and exposing the cavity 34 traversing the bar member. The front end 38 and rear end 40 are capable of receiving a puller support assembly 26.

The first lateral connecting member 6 of the first bar member 2 has a bar receiving member 46 that is square in cross-section and tubular, with a cavity 48 having a cross-sectional configuration and dimension slightly larger than the cross-sectional configuration and dimension of the first longitudinal bar member 2 to allow the first bar member 2 to slide through the cavity 48 of the bar receiving member 46.

The first lateral connecting member 6 has a bench receiving member 50 that is square in cross-section and tubular, with a cavity 52 having a cross-sectional configuration and dimension slightly larger than the cross-sectional configuration and dimension of the first side member 54 of the bench 12 to allow the first side member 54 to slide through the cavity 52 of the bench receiving member 50.

The bar receiving member 46 and the bench receiving member 50 are connected together by a short metal connector bar 56 of comparable dimensions to the bar receiving member 46. The bar receiving member 46 and the bench receiving member 50 are orientated such that when the first longitudinal bar member 2 and the first side member 54 are inserted into cavities 48 and 52, respectively the member 2 and 54 will extend parallel to each other.

The bar receiving member 46 has two apertures 58 and 60 in the upper surface 62. Two nuts 64 are welded to the upper surface 62 so that the apertures 58 and 60 of the upper surface 62 are aligned with and of equal diameter to the apertures of the nuts 64. Set bolts 66 are screwed into the nuts 64 until the bolts 66 are firmly against the first longitudinal bar member 2 to restrain the first lateral connecting bar member 6 from moving.

The second lateral connecting member 8 of the first longitudinal bar member 2 is tubular in design and of comparable dimension to the connector bar 56 with a weld end 72 welded to the inner side 10 of the first longitudinal bar member 2 such that the upper surface 71 of second lateral connecting member 8 is in the same plane as the upper surface 82 of the first longitudinal bar member 2, and the cavity end 74 exposes the inner cavity 70. The cavity 70 has a square cross-sectional configuration and dimension slightly larger than the cross-sectional configuration and dimensions of the first end member 68 of the bench 12 to allow the first end member 68 to slide into the second lateral connecting member 8 until the first end member 68 butts against the inner side 10 of the first longitudinal bar member 2.

The second lateral connecting member 8 of the first longitudinal bar member 2 has one aperture 75 through its first side wall 77. The aperture 75 is positioned to align with an aperture of equal diameter in the first side wall 79 of the first end member 68 of the bench 12. Once aligned, a pin 81 is inserted through both aperture to insure that the first end member 68 of the bench 12 will not slip out of the second lateral connecting member 8 of first longitudinal bar member 2.

The second lateral connecting member 8 of the first longitudinal bar member 2 has one aperture 73 through its upper surface 71. One nut 64 is welded to the upper surface 62 so that the aperture 73 is aligned with and of equal diameter to the aperture of the nut 64. A set bolt 66 is screwed into the nut 66 until the bolt 66 butts firmly against the upper surface of the first end member 68 of the bench 12 to restrain the second lateral connecting member 8 from moving.

The first puller connecting member 20 attached to the outer side 11 of the first longitudinal bar member 2 is square in cross-section, tubular and equal in dimension to the first longitudinal bar member 2 except that the first puller connecting member 20 is only one foot in length. The first puller connecting member 20 has a weld end 76 that is welded to the outer side 24 of the first longitudinal bar member 2 such that the longitudinal axis of the first puller connecting member 20 is perpendicular to the longitudinal axis of the first longitudinal bar member 2, and the upper surface 80 of the first puller connecting member 20 is in the same plane as the upper surface 82 of the first longitudinal bar member 2. The first puller connecting member 20 is welded to the first longitudinal bar member 2 approximately four feet from the rear end 40 of the first longitudinal bar member 2. The first puller connecting member 20 has an aperture 84 through its first side surface 86 to receive a restraining pin 67 that restrains the puller support assembly 26 from moving when placed upon the first puller connecting member 20.

The second puller connecting member 22 attached to the outer side 24 of the first longitudinal bar member 2, is square in cross-section, tubular and an exact duplicate of the first puller connecting member 20. The second puller connecting member 22 like the first puller connecting member 20, is welded to the first longitudinal bar member 2 such that the upper surface 88 of the second puller connecting member 22 is in the same plane as the upper surface 82 of the first longitudinal bar member 2. The second puller connecting member 22 is welded to the first longitudinal bar member 2 approximately three feet from the front end 38 of the first longitudinal bar member 2. The second puller connecting member 22 has an aperture 90 through its first side wall 92 at the same location as the aperture 84 in the first puller connecting member 20 to receive a restraining pin 67 to restrain the puller support assembly 26 from moving when placed upon the second puller connecting member 22.

The front end 38 of the first longitudinal bar member 2 is also capable of receiving a puller support assembly 26. The outer side 24 of the first bar member 2 has an aperture 94 through the side at the same position as apertures 84 and 90 in the first puller connecting member 20 and the second puller connecting member 22 respectively.

Wheels 96 are attached to the bottom side 98 of the first longitudinal bar member 2 near the front end 38 and rear end 40 to enable the first longitudinal bar member 2 to be moved easily into position to be connected to the bench 12.

To enable the easy alignment between the bench 12 and first longitudinal bar member 2, a flexible air spring 100 is utilized to lift the first longitudinal bar member 2 off a floor and insert the bench 12 into the first lateral connecting member 6 and second lateral connecting member 8.

The air spring 100 is comprised of a bellows 102 with an open upper end 103 and open lower end 104 that exposes two chambers 105 and 106 formed by a girdle hoop 107 that encircles the bellows 102 at the mid-section. An upper bead plate 108 seals the upper end 103 of the bellows 102 and provides a surface which the longitudinal bar members 2 and 4 set upon. The upper bead plate 108 has an air inlet 110 to receive a pressure supply line to pressurize the bellows 102, and a blind nut 111 to "bleed" air from the bellows 102. A lower bead plate 112 seals the lower end 104 of the bellows 102 and provides a surface to set the air spring 100 upright on a floor.

The second longitudinal bar member 4 has the same dimensions as the first longitudinal bar member 2. The second longitudinal bar member 4 has a first lateral connecting member 14 to receive a second end member 114 of the bench 12.

The first lateral connecting member 14 of the second longitudinal bar member 4 has a bar receiving member 116 that is square in cross-section and tubular, with a cavity 118 having a cross-sectional configuration and dimension slightly larger than the cross-sectional configuration and dimension of the second longitudinal bar member 4 to allow the second longitudinal bar member 4 to slide through the cavity 118 of the bar receiving member 116. The first mounting member 14 has a bench receiving member 120 that is square in cross-section and tubular, with a cavity 122 having a cross-sectional configuration and dimension slightly larger than the cross-sectional configuration and dimension of the second end member 114 of the bench 12 to allow the second end member 114 to insert into the cavity 122.

The weld end 124 of the bench receiving member 120 is welded to the first side wall 126 of the bar receiving member 116 such that the upper surface 130 of the bar receiving member 116 is in the same plane as the upper surface 132 of the bench receiving member 120, and the cavity end 134 of the bench receiving member 120 exposes the inner cavity 122 with plane of the cavity end 134 parallel to the plane of the first side wall 126 of the bar receiving member 116.

The bar receiving member 116 has two apertures 136 and 138 in the upper surface 130. Two nuts 64 are welded to the upper surface 130 so that the apertures 136 and 138 are aligned with and of equal diameter to the apertures of the nuts 64. Set bolts 66 are screwed into the nuts 64 until the bolts 66 are firmly against the second longitudinal bar member 4 to restraining the first lateral connecting member 14 from moving. The second end member 114 of the bench 12 is inserted into the bench receiving member 120 of the first lateral connecting member 14 until the second end member 114 butts against the first side wall 126 of the bar receiving member 116. The position of the first lateral connecting member 14 on the second longitudinal bar member 4 is slightly forward of the first lateral connecting member 6 of the first longitudinal bar member 2 due to the design of the bench 12.

The second lateral connecting member 16 of the second longitudinal bar member 4 has a bench receiving member 140 that is square in cross-section and tubular, with a cavity 142 having a cross-sectional configuration and dimension slightly larger than the cross-sectional configuration and dimension area of the second side member 144 of the bench 12 to allow the second side member to slide through the cavity 142 of the bench receiving member 140.

The bench receiving member 140 is connected to the inner side 18 of the second longitudinal bar member 4 by utilizing a short metal connector bar 146 of comparable dimensions to the second longitudinal bar member 4 and welding the connector bar 146 to both the bench receiving member 140 and the second longitudinal bar member 4. The bench receiving member 140 and the second longitudinal bar member 4 are orientated such that when the second side member 144 of the bench 12 is inserted into the bench receiving member 140, the second side member 144 and the second longitudinal bar member 4 will have their longitudinal axis in parallel planes.

The bench receiving member 140 has one aperture 150 through its upper surface 148. One nut 64 is welded to the upper surface 148 so that the aperture 150 is aligned with and of equal diameter to the aperture of the nut 64. A set bolt 66 is screwed into the nut 64 until the set bolt 66 butts firmly against the upper surface of the second side member 144 of the bench 12 to restrain the bench receiving member 140 from moving.

The bench receiving member 140 has one aperture 152 through its first side wall 154. The aperture 152 is positioned to align with an aperture of equal diameter in the first side wall 156 of the second side member 144 of the bench 12. Once aligned, a pin 158 is inserted through both orifices to insure that the second side member 144 of the bench 12 will not slip out of the bench receiving member 140 of the second mounting member 16.

The first puller connecting member 28 attached to the outer side 32 of the second longitudinal bar member 4 is square in cross-sectional, tubular and equal in dimension to the first puller connecting member 20 attached to the first bar member 2. The first puller connecting member 28 has a weld end 160 that is welded to the outer side 32 of the second longitudinal bar member 4 such that the longitudinal axis of the first puller connecting member 28 is perpendicular to the longitudinal axis of the second longitudinal bar member 4, and the upper surface 162 of the first puller connecting member 28 is in the same plane as the upper surface 164 of the second bar member 4. The first puller connecting member 28 is welded to the second longitudinal bar member 4 approximately four feet from the rear end 44 of the second longitudinal bar member 4. The first puller connecting member 28 has an aperture 166 through its first side surface 168 to receive a restraining pin 67 that restrains the puller support assembly 26 from moving when placed upon the first puller connecting member 28.

The second puller connecting member 30 attached to the outer side 32 of the second longitudinal bar member 4, is square in cross-section, tubular and an exact duplicate of the first puller connecting member 28. The second puller connecting member 30 like the first puller connecting member 28, is welded to the second longitudinal connecting member 30 is in the same plane as the upper surface 164 of the second longitudinal bar member 4. The second puller connecting member 30 is welded to the second longitudinal bar member 4 approximately three feet from the front end 42 of the second longitudinal bar member 4. The second puller connecting member 30 has an aperture 172 through its first side wall 174 at the same location as the aperture 166 in the first puller connecting member 28 to receive a restraining pin 67 to restrain the puller support assembly 26 from moving when placed upon the second puller connecting member 30.

The front end 42 of the second longitudinal bar member 4 is also capable of receiving a puller support assembly 26. The inner side 18 of the second bar member 4 has an aperture 176 through the side at the same position as apertures 166 and 172 in the first receiving member 28 and the second receiving member 30 respectively.

Wheels 96 are attached to the bottom side 178 of the second longitudinal bar member 4 near the front end 42 and rear end 44 to enable the second longitudinal bar member 4 to be moved easily into position to be connected to the bench 12.

To enable easy alignment between the bench 12 and the second longitudinal bar member 4, an air spring 100 is utilized to lift the second longitudinal bar member 4 off a floor and insert the bench 12 into the first lateral connecting member 14 and second lateral connecting member 16 of the second longitudinal bar member 4.

The puller support assembly 26 is comprised of a sleeve 180 square in cross-section, tubular and approximately eight inches long with a cavity 182 having a cross-sectional configuration and dimension slightly larger than the cross-sectional configuration and dimension of the longitudinal bar member 2 and 4 and the puller connecting members 20, 22, 28 and 30 to enable the sleeve 180 to slide on the aforementioned members.

The sleeve 180 has a weld end 184 that welds to a first flange member 186. The first flange member 186 is approximately eight inches in diameter and one inch thick with a plurality of apertures 188 positioned circumferentially around the perimeter of the flange 186. The apertures 188 are approximately one-half inch in diameter and spaced apart one-half inch around the perimeter of the flange 186. A receiving aperture 190 one inch in diameter is centered in the flange 186. A solid cylindrical bar 194 one inch in diameter and approximately eight inches long is inserted and welded in the receiving aperture 190. The weld fend 184 of the sleeve 180 is centered and welded to the first side wall 192 of the flange 186.

A second flange member 196 that is equal in dimensions to the first flange member 186, has a plurality of apertures 198 positioned circumferentially around its perimeter such that the apertures 198 align with and are equal in dimension to the apertures 188 of the first flange member 186. An aperture 200 is centered in the second flange member 196 that aligns with and is of equal dimensions to the receiving aperture 190 of the first flange member 186.

A tubular puller support post 202 approximately four feet long and four inches in diameter with a cylindrical wall 206 having a thickness dimension of one-quarter inch is attached to the second flange member 196. A plurality of apertures 204 approximately one-half inch in diameter traverse the length of the tubular puller support post 202 in a linear arrangement in two rows 208 and 210 parallel with the longitudinal axis of the tubular puller support post 202 with the rows diagonally opposite each other. Adjacent apertures 204 in row 208 are spaced apart six inches and are diagonally opposite and aligned with apertures 204 in row 210 to allow a puller to mount to the tubular puller support post 202.

The apertures 212 and 213 closest the flange end 214 of the tubular puller support post 202 are the same dimensions as the aperture 200 centered in the second flange 196. The tubular puller support post 202 is attached to the second flange 196 by utilizing two welding plates 216 and 218 that are welded to both the pipe 202 and the first side wall 220 of the second flange 196. The pipe 202 is positioned such that the apertures 212 and 213 are aligned with the aperture 200 centered in the second flange 196 before the welding plates 216 and 218 are welded in place.

The bar 194 protruding from the second side wall 222 of the first flange 186 is inserted into the second flange aperture 200 and tubular puller support post 202 apertures 212 and 213 until the bar 194 protrudes through the tubular puller support post 202. A nut 224 is then screwed on the threaded end 226 of the protruding bar 194 until the second side wall 222 of the first flange 186 touches the second side wall 228 of the second flange 196. This arrangement allows the tubular puller support post 202 and second flange 196 to rotate to any desired position to orient a puller at an angle in line with a damaged portion of a car that requires straightening. Once the puller is positioned, a spring loaded retaining pin 230 is inserted through two aligned apertures 188 and 198 of the first flange 186 and second flange 196 to secure the position of the puller.

The spring loaded retaining pin 230 includes a coupling 232 welded to align with an aperture 188 in the first side wall 192 of the first flange member 186. A retaining pin 230, with a spring washer 235 integrally mounted to the retaining pin 230, is inserted into the coupling 232 until the spring washer 235 touches the first side wall 192 of the first flange member 186 with the retaining pin 230 protruding through the aperture 188 of the first flange member 186 and an aligned aperture 198 in the second flange member 196. A spring 233 is slipped over the retaining pin 230 until the spring touches the spring washer 235. A spring retaining bushing 237 is slipped over the retaining pin 230 and screwed into the coupling 232. The spring 233 can be compressed a distance large enough to allow the retaining pin 230 to be withdrawn from the aperture 198 in the second flange member 196 to allow the second flange member 196 to rotate to position the tubular puller support post 202 adjacent to a bent portion of an auto body with the apertures 188 of the first flange member 186 in alignment with the apertures 198 of the second flange member 196. The retaining pin 230 is allowed to insert into the aligned apertures with the spring 233 securing the position of the retaining pin 230 to prevent the tubular puller support post 202 from rotating.

The puller assembly 26 is secured to the puller connecting members 20, 22, 28 and 30 or the longitudinal bar members 2 and 4 that the puller assembly 26 is placed upon by utilizing a sleeve retaining pin 67 that inserts through an aperture 236 in the first side wall 238 of the sleeve 180 and through the aligned aperture of the respective member upon which the sleeve 180 is placed.

Once the bent auto body section is straightened, the puller support assembly 26 is easily removed from the member the puller assembly is placed upon by simply removing the retaining pin 67 and sliding the sleeve 180 off the member the sleeve 180 was placed upon and relocating the puller assembly upon a member adjacent to another bent area of the auto body.

The bench mounted puller support along with the bench 12 and puller 240 operates by first mounting a bent auto body on a bench 12. The auto body is secured to the bench by utilizing clamps 242, which are anchored to the bench, that grip the auto body at the frame 244.

The bench mounted puller support is then mounted to the bench 12 supporting the auto body as detailed in the aforementioned description. The puller support assembly 26 is then placed upon the first puller connecting member 20 to straighten the bent left rear side section of the auto body by sliding the sleeve 180 upon the first puller connecting member 20 and then inserting the retaining pin 67 through the sleeve aperture 236 and the aligned aperture 84 in the first puller connecting member 20.

The second flange member 196 is then rotated until the tubular puller support post 202, which is attached to the second flange member 196, is adjacent to the bent portion of the auto body. The puller 240 is then placed upon the tubular puller support post 202 in direct alignment with the bent portion of the auto body such that the longitudinal axis of the tubular puller support post 202 is perpendicular with the direction of movement of the puller 240. The puller 240 is secured to the tubular puller support post 202 and coupled to the bent portion of the auto body. The puller is then actuated by an air supply to straighten the bent portion of the auto body.

The aforementioned procedure can be utilized to straighten any area on the left rear side section of an auto body by orienting the attitude of the tubular puller support post 202 from below horizontal, for example, which aligns with the lower portion of the car, to vertical and any desired angle in between. Further flexibility is provided with the puller support post 202 having multiple apertures traversing the tubular puller support post 202 longitudinally to provide connecting points for the puller 240 to be secured at a plurality of locations along a four foot radius which is the length of the tubular puller support post 202.

The puller support assembly 26 is then removed from puller connecting member 20 by removing the retaining pin 67 and sliding the sleeve 180 off the first puller connecting member 20. The puller support assembly 26 is rotated to the second puller connecting member 22 to straighten the bent left front side section of the auto body. The sleeve 180 of the puller support assembly 26 is slipped over the second puller connecting member 22 and the retaining pin 67 is inserted through the sleeve aperture 236 and the aligned aperture 90 in the second puller connecting member 22 to secure the puller support assembly 26.

The bent portion of the left front side section of the auto body is straightened by following the same procedure utilized to straighten the left rear side section. The puller support assembly 26 is then removed from the second puller connecting member 22 and is relocated to the front end 38 of the first longitudinal bar member 2. The sleeve 180 of the puller support assembly 26 is slipped over the front end 38 and the retaining pin 67 is inserted through the sleeve aperture 236 and the aligned aperture 94 in the outer side 24 near the front end 38 of the first longitudinal bar member 2.

The bent portion of the left front end section of the auto body is straightened by following the procedure detailed above. The puller support assembly 26 is then removed from the front end 38 of the first longitudinal bar member 2 and is relocated to the front end 42 of the second longitudinal bar member 4. The sleeve 180 is slipped over the front end 42 and the retaining pin 67 is inserted through the sleeve aperture 236 and the aligned aperture 176 in the inner side 18 near the front end 42 of the second longitudinal bar member 4. The bent portion of the right front end section of the auto body is straightened by following the procedures detailed above. The puller support assembly 26 is then removed from the front end 42 of the second longitudinal bar member 4 and is relocated to the second puller connecting member 30 of the second longitudinal bar member 4. The sleeve 180 is slipped over the second puller connecting member 30 and the retaining pin 67 is inserted through the sleeve aperture 236 and the aligned aperture 172 in the second puller connecting member 30.

The bent portion of the right front side section of the auto body is straightened by following the procedures detailed above. The puller support assembly 26 is then removed from the second puller connecting member 30 and is relocated to the first puller connecting member 28 of the second longitudinal bar member 4. The sleeve 180 is slipped over the first puller connecting member 28 and the retaining pin 67 is inserted through the sleeve aperture 236 and the aligned aperture 166 in the first puller connecting member 28.

The bent portion of the right rear side section of the auto body is straightened by following the procedures detailed above. If the rear end of the auto body requires straightening, the auto body is oriented such that the rear end of the auto body faces toward the front ends 38 and 42 of the first longitudinal bar member 2 and the second longitudinal bar member 4. The puller support assembly 26 is then slipped over the front end 38 of the first longitudinal bar member 2 to straighten the bent right rear end section of the auto body. The retaining pin 67 is inserted through the sleeve aperture 236 and the aligned aperture 94 in the outer side 24 of the first longitudinal bar member 2.

The bent portion of the right rear end section of the auto body is straightened by following the procedures detailed above. The puller support assembly 26 is then removed from the front end 38 of the first longitudinal bar member 2 and is relocated to the front end 42 of the second longitudinal bar member 4. The sleeve 180 is slipped over the front end 42 and the retaining pin 67 is inserted through the sleeve aperture 236 and the aligned 176 in the inner side 18 near the front end 42 of the second longitudinal bar member 4. The bent portion of the left rear end section of the auto body is straightened by following the procedures detailed above.

The puller support assembly 26 is removed from the front end 42 of the second longitudinal bar member 4 and set aside until required for another project. The first longitudinal bar member 2 and second longitudinal bar member 4 are removed from the bench 12 and are set aside until required for another project.

I claim:

1. A vehicle having a damaged body portion in combination with a dual support assembly for supporting both said vehicle having a said damaged body portion and a pulling mechanism to straighten such damaged body portion, including said pulling mechanism, said dual support assembly comprising vehicle support means to hold said vehicle on said dual support assembly at a first location and pulling mechanism support means to hold said pulling mechanism on said dual support assembly at a second location spaced apart from said first location and said vehicle support means, said pulling mechanism including puller connecting means to connect said pulling mechanism on said pulling mechanism support means to a said vehicle having a damaged body portion when held on said spaced apart vehicle support means, said pulling mechanism support means being detachably connected to said vehicle support means for use of said pulling mechanism support means with other vehicle support means and vehicles mounted thereon for repair while said first mentioned vehicle remains on said first mentioned vehicle support means and said pulling mechanism remains on said pulling mechanism support means, said pulling mechanism support means including transport means to transport it from one vehicle support means after use therewith to another vehicle support means and vehicle thereon for repair.

2. A dual support assembly for supporting both a vehicle having a damaged body portion and a pulling mechanism to straighten such damaged body portion as set forth in claim 1, wherein said puller connectign means to connect said pulling mechanism to said vehicle includes a length of chain, said pulling mechanism including a powered pulling mechanism to pull said length of chain when connected to a said damaged body portion of a said vehicle in a direction toward said pulling mechanism.

3. A dual support assembly for supporting both a vehicle having a damaged body portion and a pulling mechanism to straighten such damaged body portion as set forth in claim 1, including support assembly coupling means to detachably connect said pulling mechanism support means to said vehicle support means.

4. A dual support assembly for supporting both a vehicle having a damaged body portion and a pulling mechanism to straighten such damaged body portion as set forth in claim 1, wherein said pulling mechanism is detachably connectable to said pulling mechanism support means, including pulling mechanism coupling means to detachably connect said pulling mechanism to said pulling mechanism support means.

5. A dual support assembly for supporting both a vehicle having a damaged body portion and a pulling mechanism to straighten such damaged body portion as set forth in claim 4, wherein said pulling mechanism coupling means to detachably connect said pulling mechanism to said pulling mechanism support means includes a plurality of pulling mechanism coupling stations spaced apart from each other, at least one of said pulling mechanism coupling stations being spaced apart outwardly from a first side of said vehicle support means, at least one of said pulling mechanism coupling stations being spaced apart outwardly from a second side of said vehicle support means which is opposite to said first side thereof.

6. A dual support assembly for supporting both a vehicle having a damaged body portion and a pulling mechanism to straighten such damaged body portion as set forth in claim 5, wherein at least one of said plurality of pulling mechanism coupling stations is spaced apart outwardly from said vehicle support means in one direction and located at a point outwardly of and between said first side and said opposite second side, and at least one of said plurality of pulling mechanism coupling stations is spaced apart outwardly from said vehicle support means in the direction opposite to said one direction and located at a point outwardly of and between said first side and said opposite second side.

7. A dual support assembly for supporting both a vehicle having a damaged body portion and a pulling mechanism to straighten such damaged body portion as set forth in claim 1, wherein said vehicle support means includes a support frame having said vehicle mounted thereon, anchoring means to anchor said support frame to a floor, and fastening means to fasten said vehicle to said support frame.

8. A dual support assembly for supporting both a vehicle having a damaged body portion and pulling mechanism to straighten such damaged body portion as set forth in claim 7, wherein said vehicle support frame includes a plurality of lateral frame support members to detachably connect said support frame to said pulling mechanism support means.

9. A dual support assembly for supporting both a vehicle having a damaged body portion and pulling mechanism to straighten such damaged body portion as set forth in claim 7, wherein said anchor means includes a plurality of chains connected to said support frame and to said floor to maintain said support frame in a stationary position.

10. A dual support assembly for supporting both a vehicle having a damaged body portion and pulling mechanism to straighten such damaged body portion as set forth in claim 7, wherein said fastening means includes clamps connected to said support frame and to the frame members of said vehicle to maintain said vehicle in a stationary position.

11. A dual support assembly for supporting both a vehicle having a damaged body portion and pulling mechanism to straighten such damaged body portion, comprising vehicle support means to hold said vehicle on said dual support assembly at a first location and pulling mechanism support means to hold said pulling mechanism on said dual support assembly at a second location spaced apart from said first location and said vehicle support means, said pulling mechanism including puller connecting means to connect said pulling mechanism on said pulling mechanism support means to a said vehicle having a damaged body portion when held on said spaced apart vehicle support means, wherein said vehicle support means includes a support frame having said vehicle mounted thereon, anchoring means to anchor said support frame to a floor, and fastening means to fasten said vehicle to said support frame, wherein said vehicle support frame includes a plurality of lateral frame support members to connect said support frame to said pulling mechanism support means, wherein said pulling mechanism support means includes a first longitudinal bar member positioned on one side of said vehicle support frame, a second longitudinal bar member positioned on a second side of said vehicle support frame and opposite to said first longitudinal bar member, lateral connecting means to connect said first longitudinal bar member and said second longitudinal bar member to said lateral frame support members, lateral pulling mechanism connection means to connect said pulling mechanism to said first longitudinal bar member and said second longitudinal bar member, moving means to move said first longitudinal bar member to one side of said vehicle support frame and to move said second longitudinal bar member to a second side of said vehicle support frame and opposite to said first longitudinal bar member, and lifting means to lift said first longitudinal bar member to connect to said vehicle support frame and to lift said second longitudinal bar member to connect to said vehicle support frame.

12. A dual support assembly for supporting both a vehicle having a damaged body portion and pulling mechanism to straighten such damaged body portion as set forth in claim 11, wherein said first longitudinal bar member and said second longitudinal bar member are tubular with a front end and rear end having a cavity running the length thereof, said front end of said first longitudinal bar member having an aperture through the outer side wall, said front end of said second longitudinal bar member having an aperture through the inner side wall with said apertures being axially aligned.

13. A dual support assembly for supporting both a vehicle having a damaged body portion and pulling mechanism to straighten such damaged body portion as set forth in claim 11, wherein said moving means includes wheel assemblies mounted to said first longitudinal bar member and said second longitudinal bar member to position said members near said vehicle support frame.

14. A dual support assembly for supporting both a vehicle having a damaged body portion and pulling mechanism to straighten such damaged body portion as set forth in claim 11, wherein said lifting means includes an air spring member with an inflatable bellows to lift said first longitudinal bar member and said second longitudinal bar member for connection to said vehicle support frame.

15. A dual support assembly for supporting both a vehicle having a damaged body portion and pulling mechanism to straighten such damaged body portion as set forth in claim 11, wherein said lateral connecting means includes a first lateral connecting member having a first end with a cavity having a cross-section configuration and dimension slightly larger than the cross-sectional configuration and dimension of said first longitudinal bar member to receive said first longitudinal bar member, securing means to secure said first lateral connecting member to said first longitudinal bar member, said first lateral connecting member having a second end with a cavity having a cross-section configuration and dimension slightly larger than the cross-sectional configuration and dimension of a first lateral frame support member to receive said first lateral frame support member, a second lateral connecting member with a cavity running the length thereof has a first end integrally mounted to the inner side of said first longitudinal bar member and a second end having said cavity with a cross-section configuration and dimension slightly larger than the cross-sectional configuration and dimension of a second lateral frame support member to receive said second lateral frame support member, securing means to secure said second lateral connecting member to said second lateral frame support member, a third lateral connecting member having a first end with a cavity having a cross-section configuration and dimension slightly larger than the cross-sectional configuration and dimension of said second longitudinal bar member to receive said second longitudinal bar member and a second end with a cavity having a cross-section configuration and dimension slightly larger than the cross-sectional configuration and dimension of a third lateral frame support member to receive said third lateral frame support member, a fourth lateral connecting member with a first end integrally mounted to the inner side of said second longitudinal bar member and a second end having a cavity with a cross-section configuration and dimension slightly larger than the cross-sectional configuration and dimension of a fourth lateral frame support member to receive said fourth lateral frame support member, and second securing means to secure said fourth lateral connecting member to said fourth lateral frame support member.

16. A dual support assembly for supporting both a vehicle a damaged body portion and pulling mechanism to straighten such damaged body portion as set forth in claim 15, wherein said securing means to secure said first lateral connecting member to said first longitudinal bar member and said third lateral connecting member to said second longitudinal bar members includes apertures through the upper surface of said first ends of said first and third lateral connecting members and lock nuts integrally mounted to said upper surfaces with said lock nuts axially aligned with said apertures and said lock nuts receiving lock bolts to insert through said apertures to secure said first lateral connecting member to said first longitudinal bar member and to secure said third lateral connecting member to said second longitudinal bar member, said securing means to secure said second lateral connecting member to said second lateral frame support member includes apertures through both first side surfaces of said second lateral connecting member and said second lateral frame support member with said apertures axially aligned to receive pins to secure said second lateral frame support member to said second lateral connecting member, said securing means to secure said fourth lateral connecting member to said fourth lateral frame support member includes apertures through both first side surfaces of said fourth lateral connecting member and said fourth lateral frame support member with said apertures axially aligned to receive pins to secure said fourth lateral frame support member to said second lateral connecting member.

17. A dual support assembly for supporting both a vehicle having a damaged body portion and pulling mechanism to straighten such damaged body portion as set forth in claim 11, wherein said lateral pulling mechanism connection means includes a plurality of lateral pulling mechanism connection members integrally mounted to said outer side wall of said first longitudinal bar member and a plurality of lateral pulling mechanism connection members integrally mounted to the outer side wall of said second longitudinal bar member, a sleeve member with a cavity running the length thereof with a cross-sectional configuration and dimension slightly larger than the cross-sectional configuration and dimension of said lateral pulling mechanism connection members to fit over said lateral pulling mechanism connection members, a pulling mounting post to support said pulling mechanism, post rotating means to support and rotate said puller mounting post around a first end of said puller mounting post, puller positioning means to adjust the position of said pulling mechanism on said puller mounting post and securing means to secure said sleeve to said lateral pulling mechanism connection members.

18. A dual support assembly for supporting both a vehicle having a damaged body portion and pulling mechanism to straighten such damaged body portion as set forth in claim 17, wherein said puller mechanism positioning means includes said puller mounting post having two longitudinal rows of apertures parallel to the longitudinal axis of said puller mounting post with said rows being radially displaced 180 degrees circumferentially about the longitudinal axis of said puller mounting post with said apertures in opposite rows being axially aligned with said axial alignment parallel to the longitudinal axis of said bar member to receive a pulling mechanism to straighten the damaged portion of a vehicle.

19. A dual support assembly for supporting both a vehicle having a damaged body portion and pulling mechanism to straighten such damaged body portion as set forth in claim 17, wherein said securing means to secure said sleeve member to said lateral pulling mechanism connection members includes an aperture through said sleeve member axially aligned with an aperture through each of said lateral pulling mechanism connection member to receive a retaining pin member to secure the position of said sleeve member.

20. A dual support assembly for supporting both a vehicle having a damaged body portion and pulling mechanism to straighten such damaged body portion as set forth in claim 17, wherein said post rotating means includes a first flange member with a plurality of apertures circumferentially positioned through said first flange member and with an aperture axially positioned with said first flange member having a first side wall integrally mounted to the flange end of said sleeve member, a bar member is integrally mounted to said first flange member at said axially positioned aperture, a second flange has a plurality of apertures circumferentially positioned through said second flange member and with an aperture axially positioned to allow said bar member to pass through said second flange member, said second flange member being placed adjacent to said first flange member, said puller mounting post being integrally mounted to said first side wall of said second flange member, said puller mounting post having an aperture through the first end to allow said bar member to pass through said puller mounting post, said bar member having a threaded end protruding through said second flange member, a nut member is screwed on said threaded end of said bar member to secure said second flange member to said first flange member, a spring loaded bolt assembly inserts through a circumferentially positioned aperture of said first flange member and an aligned circumferentially positioned aperture of said second flange member to lock the position of said puller mounting post after said puller mounting post had been rotated to the desired position.

21. A dual support assembly for supporting both a vehicle having a damaged body portion and pulling mechanism to straighten such damaged body portion as set forth in claim 20, wherein said spring loaded bolt assembly includes a coupling member integrally mounted to said first side wall of said first flange member with a circumferentially positioned aperture axially aligned with said coupling member, a retaining pin with a spring washer integrally mounted thereto is inserted into the coupling and through aligned apertures in said first flange member and second flange member, a spring member is placed around said retaining pin, with a bushing having an aperture axially positioned to receive said retaining pin, is screwed into said coupling and thereby compressing said spring to force said retaining pin to protrude through said aligned apertures of said first flange member and said second flange member.

22. A dual support assembly for supporting both a vehicle having a damaged body portion and a pulling mechanism to straighten such damaged body portion comprising vehicle support means to hold said vehicle on said dual support assembly at a first location and pulling mechanism support means to hold said pulling mechanism on said dual support assembly at a second location spaced apart from said first location and said vehicle support means, said pulling mechanism including puller connecting means to connect said pulling mechanism on said pulling mechanism support means to a said vehicle having a damaged body portion when held on said spaced apart vehicle support means, wherein said vehicle support means includes a support frame having said vehicle mounted thereon, anchoring means to anchor said support frame to a floor, and fastening means to fasten said vehicle to said support frame, wherein said vehicle support frame includes a plurality of lateral frame support members to connect said support frame to said pulling mechanism support means, wherein said pulling mechanism is detachably connectable to said pulling mechanism support means, including pulling mechanism coupling means to detachably connect said pulling mechanism to said pulling mechanism support means, said pulling mechanism includes an elongated mounting post having a coupling end and an opposite free end, a powered pulling mechanism mounted on said elongated mounting post at an intermediate location between said coupling end and said free end thereof, said pulling mechanism coupling means including pivot means to pivotally couple said coupling end of said elongated mounting post to said pulling mechanism support means for pivotal movement between as horizontal position and a vertical position, and mounting post holding means to hold said mounting post in a desired position in and between said horizontal position and said vertical position and for operation of said powered pulling mechanism mounted thereon when held in such position.

* * * * *